US007438034B2

(12) United States Patent
Meintschel et al.

(10) Patent No.: US 7,438,034 B2
(45) Date of Patent: Oct. 21, 2008

(54) CAMSHAFT-ADJUSTING DEVICE

(75) Inventors: Jens Meintschel, Esslingen (DE); Thomas Stolk, Kirchheim (DE); Alexander von Gaisberg-Helfenberg, Beilstein (DE)

(73) Assignee: Daimler A G, Stuttgart (DE)

( * ) Notice: Subject to any disclaimer, the term of this patent is extended or adjusted under 35 U.S.C. 154(b) by 0 days.

(21) Appl. No.: 11/726,733

(22) Filed: Mar. 22, 2007

(65) Prior Publication Data

US 2007/0266975 A1 Nov. 22, 2007

Related U.S. Application Data

(63) Continuation-in-part of application No. PCT/EP2005/010105, filed on Sep. 20, 2005.

(30) Foreign Application Priority Data

Sep. 24, 2004 (DE) ..... 10 2004 046 363

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | |
|---|---|---|---|
| 5,542,383 | A | 8/1996 | Clarke et al. |
| 6,122,984 | A | 9/2000 | Willmot |

FOREIGN PATENT DOCUMENTS

| | | |
|---|---|---|
| DE | 41 33 408 | 4/1993 |
| EP | 0 512 699 | 11/1992 |
| EP | 0 999 357 | 5/2000 |
| FR | 2 809 152 | 11/2001 |
| WO | WO 99/36677 | 7/1999 |
| WO | WO 02/101207 | 12/2002 |

*Primary Examiner*—Zelalem Eshete
(74) *Attorney, Agent, or Firm*—Klaus & bach

(57) ABSTRACT

In a camshaft adjusting device comprising an adjusting mechanism for adjusting the phase positions of first and second camshafts with respect to a crankshaft driving the camshaft adjusting device, the adjusting mechanism includes an adjustment input and first and second outputs connected to the first and second camshafts respectively, with first and second transmission ratios, respectively, for changing the phase angles between the drive input and the first and second outputs respectively, at different rates when the adjustment input is actuated.

19 Claims, 6 Drawing Sheets

CAMSHAFT-ADJUSTING DEVICE

This is a Continuation-In-Part Application of pending International Patent Application PCT/EP2005/010105 filed Sep. 20, 2005 and claiming the priority of German Patent Application 10 2004 046 363.8 filed Sep. 24, 2004.

BACKGROUND OF THE INVENTION

The invention relates to a camshaft-adjusting device with first and second camshafts and means for adjusting the phase position of the two camshafts relative to a crankshaft driving the camshafts.

In a conventional reciprocating internal combustion engine with a cylinder head including gas exchange channels and gas exchange control elements, use is made of inlet and outlet valves at the inlet side and outlet side which valves are operated by camshafts. In order to operate the internal combustion engine favorably in terms of fuel consumption and favorably in terms of engine emissions, it is known to adjust the phase position of a camshaft bearing the cams in relation to a crankshaft driving said camshaft. In an arrangement with a camshaft for the inlet valves and a camshaft for the outlet valves, it is advantageous if each of the camshafts is in each case rotatable with respect to the crankshaft. An arrangement of this type is known, for example, from the U.S. Pat. No. 5,543,383. In this case, a crankshaft drives a first camshaft for inlet valves, which camshaft in turn uses a driving means to drive a second camshaft for driving the outlet valves. An adjusting device which permits adjustment of the camshaft to a retarded or advanced position is arranged on the first camshaft. If the adjusting device is actuated and the first camshaft is changed in its phase position with respect to the crankshaft via a displaceable piston of the adjusting device, the other camshaft follows via a mechanical coupling and likewise changes its phase position in relation to the crankshaft.

It is the object of the present invention to provide a camshaft-adjusting device for two camshafts, which device is relatively small and can be manufactured cost-effectively and, in particular, is suitable for an adjusting device with a rotary actuator.

SUMMARY OF THE INVENTION

In a camshaft adjusting device comprising an adjusting mechanism for adjusting the phase positions of first and second camshafts with respect to a crankshaft driving the camshaft adjusting device, the adjusting mechanism includes an adjustment input and first and second outputs connected to the first and second camshafts respectively, with first and second transmission ratios, respectively, for changing the phase angles between the drive input and the first and second outputs respectively, at different rates when the adjustment input is actuated.

A first transmission ratio is provided for an adjusting gear between an adjustment input and a first output of the camshaft-adjusting device and a second transmission ratio is provided for the adjusting gear between the adjustment input and a second output. In this case, the first camshaft is arranged at the first output and the second camshaft is arranged at the second output. The camshaft-adjusting device has a rotary actuator and a four-shaft summing gear with two revolving summing gears which are located in a common housing. The camshaft-adjusting device is preferably cylindrically symmetrical. Its cylinder axis coincides with the axis of rotation of the input shaft. The kinematic degree of freedom of the four-shaft summing gear is two, and therefore, if speeds of rotation are predetermined at two shafts, the speeds of rotation of the other two shafts are defined.

The four shafts comprise an input shaft connected to a drive, an adjustment input connected to an adjustment input shaft and two output shafts connected to the camshafts. The input of the adjusting gear, which is designed as a summing gear, can be driven in a customary manner via a driving means extending from a crankshaft of an internal combustion engine to the drive, for example a chain or a belt. The adjustment input is connected to a rotary actuator as the actuating drive, which applies a variable torque. In the adjusting gear, a rotational movement of the input shaft and of the adjustment input shaft are combined and produce the rotational movement of the output shafts. A customary control unit can determine optimum opening parameters, such as start of opening, duration of opening, opening stroke, of inlet valves and/or outlet valves in a manner known per se as a function of a requirement of the driver and other operating parameters of the vehicle and/or engine, and can issue a corresponding adjustment command to the rotary actuator, which results in the adjustment of the phase positions of the two camshafts.

The first camshaft and the second camshaft can preferably be driven in parallel by means of a drive of the input shaft, with the drive being in engagement with in each case one partial gear of the adjusting gear, which partial gear is formed by one of the two revolving summing gears, with one of the partial gears being assigned to the first or second camshaft. In contrast to the prior art, the camshafts are therefore not in driving connection with each other but rather each is driven independently by the drive, which for example is a chain wheel. The arrangement according to the invention permits adjustment of the two camshafts as a function of each other, but with a differing degree of rotation. This advantageously results in a saving on construction space and weight for the camshaft-adjusting device according to the invention.

In an advantageous development, a first driven internal gearwheel with an internal toothing is provided for driving the first camshaft and a second driven internal gearwheel, which is spaced apart axially, with respect to the axis of rotation of the driven internal gearwheel, from the first one and has an internal toothing, is provided for driving the second camshaft. The first driven internal gearwheel is connected to the first camshaft and the second driven internal gearwheel is connected to the second camshaft. The driven internal gearwheels are expediently arranged coaxially.

A driving internal gear wheel with an internal toothing is preferably provided and is in driving connection with the two driven internal gearwheels. The driving internal gearwheel is expediently coaxial with the driven internal gearwheels. The first driven internal gearwheel interacts with said first partial gear while the second driven internal gearwheel interacts with said second partial gear. In this case, preferred planet wheels of an epicyclic gear, in particular of a planet gear, with corresponding partial gears, can be provided, with one or more planet wheels being in engagement with the driving internal gearwheel and both driven internal gearwheels simultaneously, or one or more planet wheels each being in engagement with the driving internal gearwheel and one of the driven internal gearwheels.

The invention is suitable particularly for "single overhead camshaft" internal combustion engines, in which inlet cams and outlet cams are located on a coaxial camshaft arrangement with two coaxial camshafts which may also be referred to as partial camshafts. In order to be able to adjust the latter, the inlet cams are, for example, connected in a rotationally fixed manner to the tubular outer camshaft. A further shaft is located rotatably in the latter and, via corresponding cutouts in the tube, can rotate the outlet cams, which are connected to it in a rotationally fixed manner. This arrangement permits the use of a very compact and simple four-shaft summing gear.

In a preferred first refinement of the invention, a sun wheel is provided truly axially in the adjusting gear.

The refinement corresponds to a tandem coupling planet gear composed, for example, of a centrally arranged driving internal gearwheel and two driven internal gearwheels which are arranged axially in front of or behind it and are connected to the two camshafts or partial camshafts. In an advantageous development of the first refinement, a first planet wheel or a set of first planet wheels can be arranged between the sun wheel and the first driven internal gearwheel, which planet wheels are in engagement with the sun wheel and the first driven internal gear wheel. A set of planet wheels is to be understood as meaning two or more planet wheels which are arranged next to one another at the same axial location. The sun wheel is arranged fixedly on the input shaft. A second planet wheel or a second set of planet wheels can preferably be arranged between the sun wheel and the second driven internal gear wheel, which planet wheels are in engagement with the sun wheel and the second driven internal gearwheel and the driving internal gearwheel. The planet wheel or the set of planet wheels is preferably inserted loosely between sun wheel and driven internal gearwheels. The sun wheel can advantageously have two toothings in order to bring about a different transmission ratio between the adjustment input and the first and second output. The planet wheel or the planet wheels then expediently has or have a different diameter.

Alternatively, the first planet wheel and the second planet wheel or the first and second sets of planet wheels and the corresponding driven internal gearwheels can have different numbers of teeth. This is expedient if the sun wheel only has a single toothing. By means of a profile correction during the production of the pairs of gearwheels, the planet wheels run on the same diameter and thus bring about a different transmission ratio between the adjustment input and each of the two outputs.

In an advantageous development of the first refinement, a planet wheel or a set of planet wheels can be arranged between the sun wheel and the first and second driven internal gearwheels and is simultaneously in engagement with both driven internal gearwheels and the driving internal gearwheel. A different transmission ratio by means of different numbers of teeth of the driven internal gearwheels on the same diameter is brought about during the production of the gearwheels by means of profile correction.

In order to adjust the phase position between the camshafts, the sun wheel is rotatable, in particular by means of an electric servomotor or a preferably electric or electromagnetic brake.

In a second preferred refinement of the invention, an eccentric shaft is provided truly axially in the adjusting gear. The arrangement corresponds to a tandem eccentric gear, in which two planet wheels or two sets of planet wheels are mounted spaced apart axially on the eccentric.

In an advantageous development of the second refinement, a planet wheel or a set of planet wheels is arranged on the eccentric shaft, the planet wheel or the set of planet wheels being simultaneously in engagement with the driven internal gearwheels and the driving internal gearwheel.

In an alternative advantageous development, two axially spaced-apart planet wheels or sets of planet wheels are arranged on the eccentric shaft, with each of the planet wheels being respectively in engagement with one of the driven internal gearwheels. The planet wheels preferably have different numbers of teeth.

In a further alternative development, the eccentric shaft can be designed as a double eccentric with two partially eccentric regions. In this case, each planet wheel or set of planet wheels can preferably be arranged on a partial eccentric region of the double eccentric. The planet wheels preferably have different diameters.

A different transmission ratio can be brought about, as described above, by different numbers of teeth of the driven internal gearwheels, which are located on the same diameter, being provided and/or different numbers of teeth of the planet wheels and/or different diameters of the planet wheels being provided.

In order to adjust the phase position, the eccentric shaft is preferably rotatable.

In a third refinement of the invention, a sun wheel is arranged truly axially in the adjusting gear. In this refinement, a driving internal gearwheel is not provided but rather the drive is designed as a planet carrier on which bearing bolts for planet carriers are arranged.

Two axially spaced-apart first and second planet wheels or first and second sets of planet wheels can be arranged eccentrically on the planet carrier. Alternatively, two first and second planet wheels or first and second sets of planet wheels can be arranged on a non-eccentric planet carrier. The planet wheels or sets of planet wheels can be in engagement simultaneously with both driven internal gearwheels.

The driven internal gearwheels can have a different number of teeth on the same diameter in their internal toothing, and the different transmission ratio can be brought about during the production of the gearwheels by means of profile correction.

The invention is suitable for coaxially arranged camshafts. It can alternatively be provided that the two camshafts are arranged radially next to each other. In this case, the second driven internal gearwheel advantageously has a wheel drive with an external toothing for driving the second camshaft. This variant is suitable for double overhead camshaft internal combustion engines.

The invention will be described below in more detail based on an exemplary embodiment with reference to the accompanying drawings.

DESCRIPTION OF VARIOUS EMBODIMENTS

In the figures, elements which are identical or essentially identical are numbered with the same reference numbers.

Figure 1:
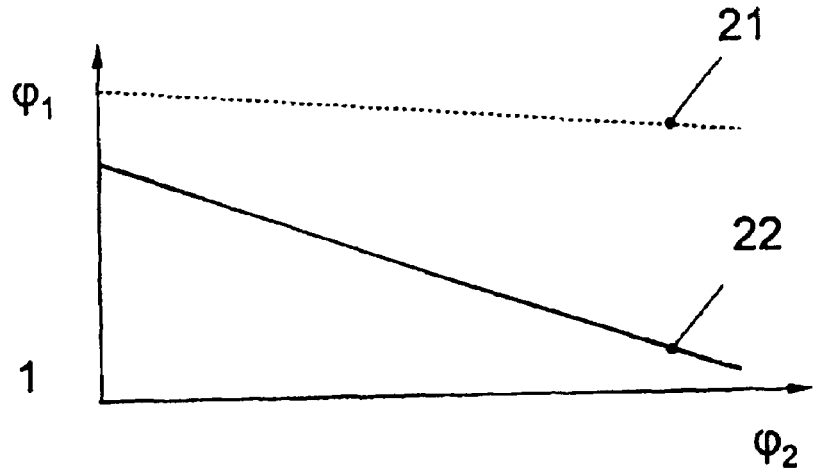
FIG. 1 shows a comparison of a relative angular position with respect to the crankshaft as a function of a relative angle of rotation of an adjustment input for a first and a second camshaft, which can be adjusted by a camshaft-adjusting device according to the invention.

As is apparent from FIG. 1, an adjustment of two camshafts 21', 22' as a function of each other, but with a differing degree of rotation, takes place by means of a camshaft-adjusting device according to the invention. While the relative angular position $\phi_1$ of the first camshaft 21' to an associated crankshaft only decreases to a small extent as a function of a relative angle of rotation $\phi_2$ of an adjustment input, the relative angular position of the second camshaft 22' changes to a substantially greater extent as the angle of rotation $\Phi_2$ of the adjustment input increases.

Figure 2:
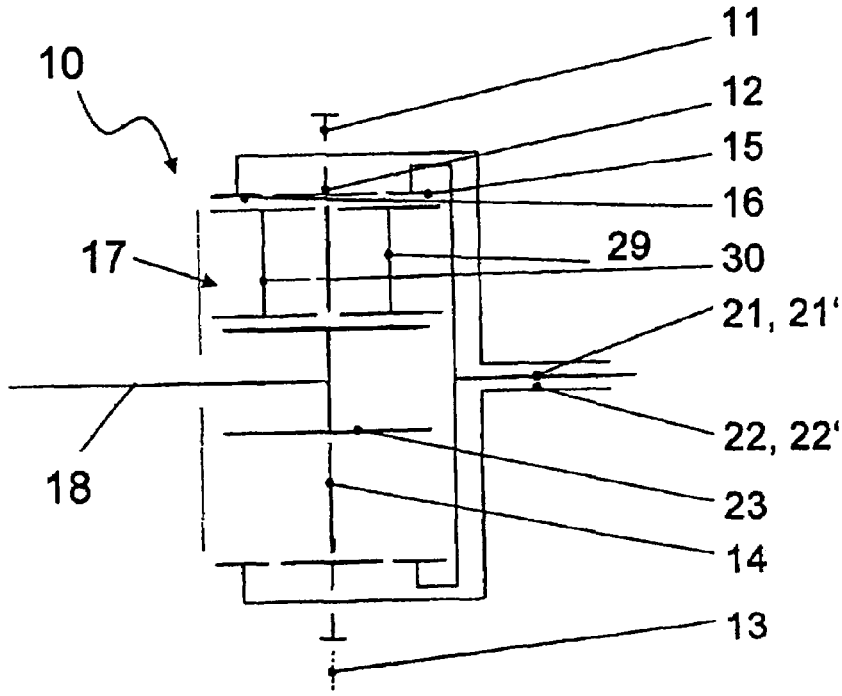
FIG. 2 shows a first arrangement of a tandem coupling planet gear with a sun wheel with a single toothing.
Figure 3:
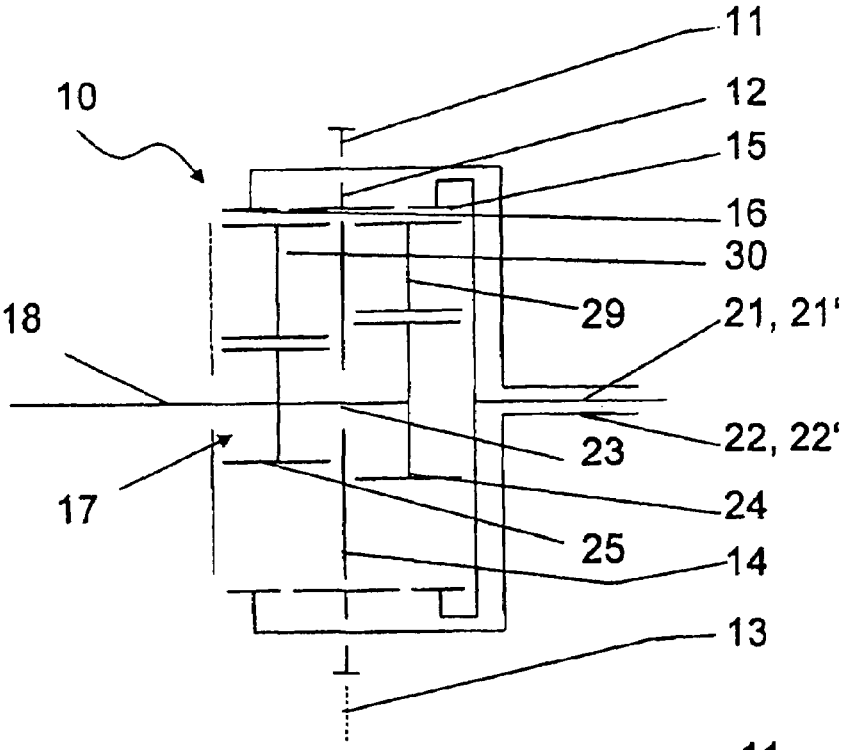
FIG. 3 shows a second arrangement of a tandem coupling planet gear with sun wheel with two toothings with different diameters and planet wheels of different diameters.
Figure 4:
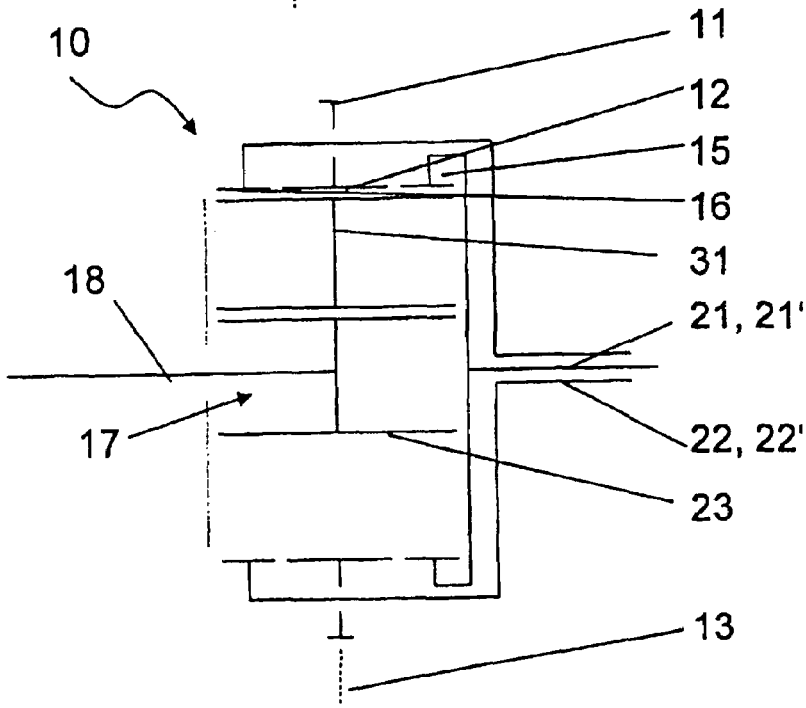
FIG. 4 shows a third arrangement of a tandem coupling planet gear with a sun wheel with a toothing and with a planet wheel.

FIGS. 2 to 4 show variants of a first embodiment of a camshaft-adjusting device 10 according to the invention with an adjusting gear 17 designed as a tandem coupling planet gear. A phase position between two camshafts 21' and 22' can be changed by rotation of a sun wheel 23.

A centrally arranged driving internal gearwheel 12 with an internal toothing of a drive 11, for example a chain wheel connected to a crankshaft (not illustrated), has, in the axial direction at opposite sides of the driving internal gearwheel 12, a first driven internal gearwheel 15 with an internal toothing, which is connected to a first camshaft 21' at a first output 21 and a second driven internal gearwheel 16 with an internal toothing, which is connected to a second camshaft 22' at a second output 22. The driving internal gearwheel 12 and the driven internal gearwheels 15, 16 are arranged coaxially. The drive 11 is connected for rotation with the crankshaft via a driving means 13, for example a chain. A sun wheel 23 with a single toothing is connected to an adjustment input 18. A loose, first planet wheel 29 is located between the sun wheel 23 and the first driven internal gearwheel 15, and a loose, second planet wheel 30 is located between the sun wheel 23 and the second driven internal gearwheel 16. Of course, further planet wheels may be provided circumferentially adjacent to the first and second planet wheels 29, 30. The first planet wheel 29 is in engagement with the driving internal gear wheel 12 and the first driven internal gearwheel 15 while the second planet wheel 30 is in engagement with the driving internal gearwheel 12 and the second driven internal gearwheel 16. The first and second planet wheels 29 and 30 are spaced apart axially by a separating disk 14. A different transmission ratio of the adjusting gearwheel 17 between the adjustment input 18 and the first output 21 and between the adjustment input 18 and the second output 22 is produced by means of different numbers of teeth of the toothings of the planet wheels 29, 30 and/or of the driven internal gearwheels 15, 16. By means of profile correction, the planet wheels 29, 30 are located on the same diameter.

A variant of the first refinement of the invention is shown in FIG. 3, in which a sun wheel 23 has two toothings 24 and 25 along its axial extent. For the description of the elements and functionalities (not explained in more detail here) reference is made to FIG. 2 above. The two toothings 24, 25 of the sun wheel 23 correspond to two axially spaced-apart, loose, first and second planet wheels 29 and 30 which are separated axially by a separating disk 14 and which are in engagement with a driving internal gearwheel 12 and the respectively associated driven internal gearwheel 15 or 16. Of course, a first and second set of planet wheels with a plurality of planet wheels may also be provided circumferentially.

FIG. 4 shows a further variant of the first embodiment of the invention, in which a sun wheel 23 with a single toothing is in engagement with a planet wheel 31 which is simultaneously in engagement with a driving internal gearwheel 12 and a first and second driven internal gearwheel 15 and 16. A plurality of circumferentially adjacent planet wheels which mesh simultaneously with the driving internal gearwheel 12 and the driven internal gearwheels 15, 16 may also be provided. For the description of further elements and functionalities (not explained) of the figure, reference is made to FIGS. 2 and 3. A different transmission ratio is brought about in turn by different numbers of teeth of the driven internal gearwheels 15, 16 on the same diameter by means of a profile correction of the gearwheels.

Figure 5:
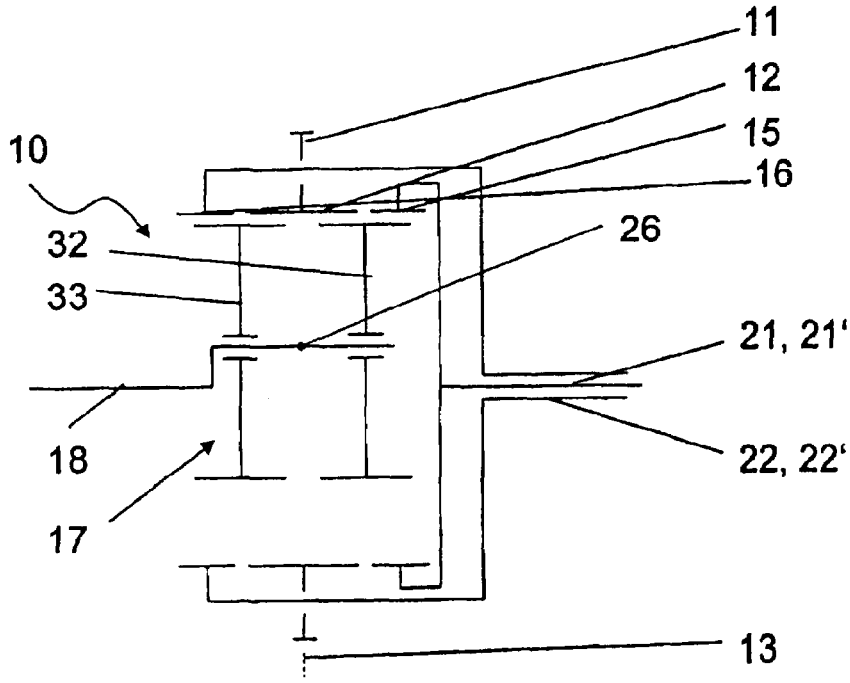
FIG. 5 shows a first arrangement of a tandem eccentric gear with a single eccentric and two planet wheels.
Figure 6:
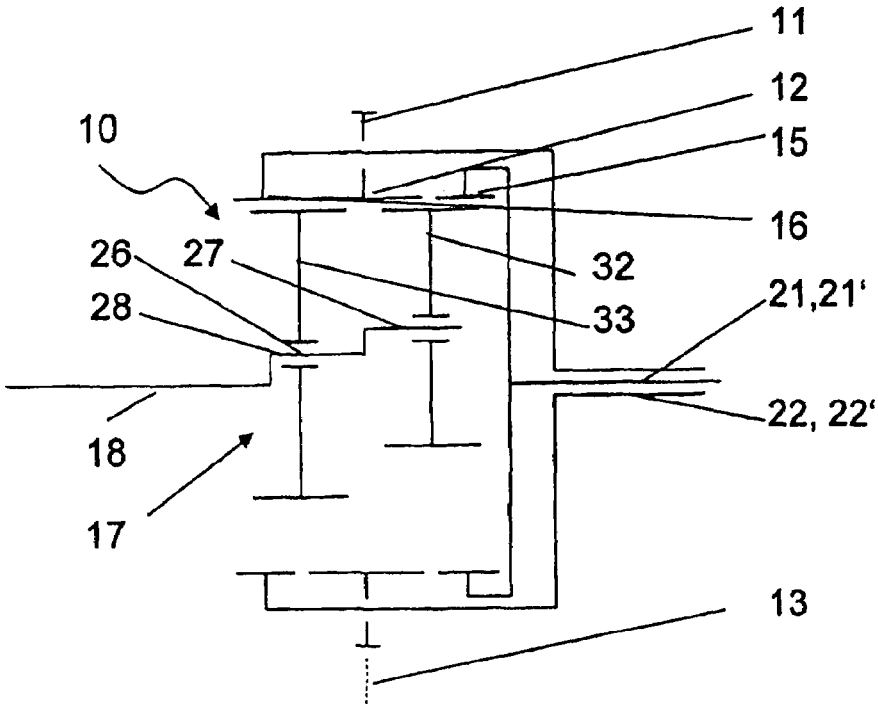
FIG. 6 shows a second arrangement of a tandem eccentric gear with a double eccentric and two planet wheels.
Figure 7:
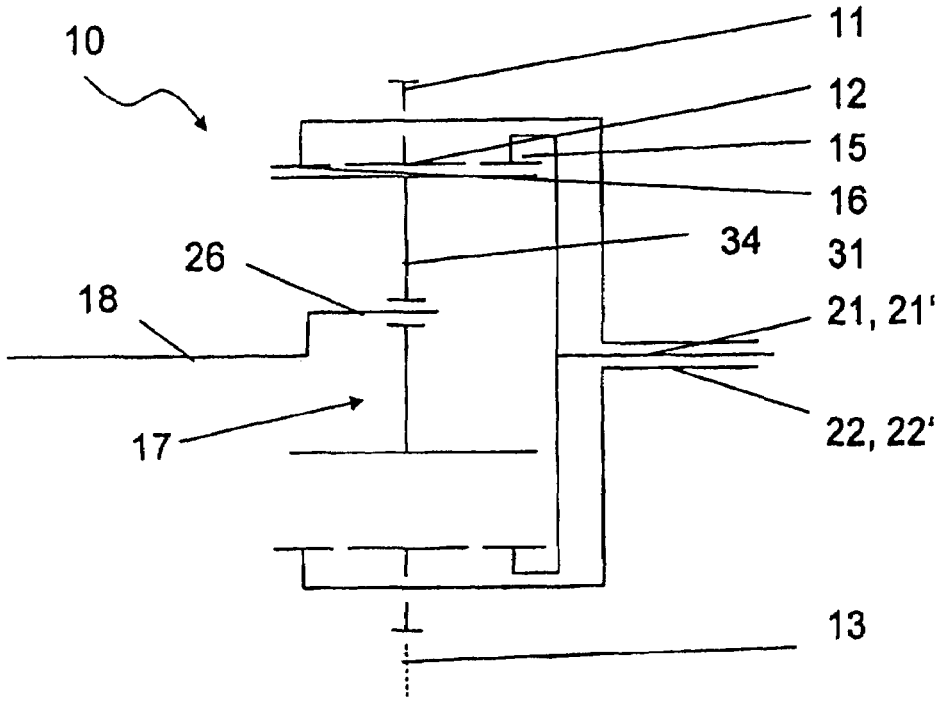
FIG. 7 shows a third arrangement of a tandem eccentric gear with a single eccentric and a planet wheel.

FIGS. 5 to 7 show variants of a second refinement of the invention, in which an adjusting gear 17 designed as a tandem eccentric gear is provided. An adjustment of two camshafts 21', 22' is brought about here by rotation of an eccentric 26 which is arranged axially and is connected to an adjustment input 18. For explanation of elements and functionalities (not described in more detail), reference is made to the above descriptions of the figures.

A first planet wheel 32 and a second planet wheel 33 are mounted in an axially offset manner on the eccentric 26. A plurality of first and second planet wheels can also be provided circumferentially. The first planet wheel 32 is in engagement with the driving internal gear wheel 12 and the first driven internal gearwheel 15, and the second planet wheel 33 is in engagement with the driving internal gearwheel 12 and with the second driven internal gearwheel 16. A different transmission ratio is produced by different numbers of teeth of the planet wheels 32, 33 and/or of the driven internal gearwheels 15, 16 on the same diameter by means of profile correction.

FIG. 6 shows a variant, in which an eccentric 26 is designed as a double eccentric with a first partial eccentric region 27 and a second partial eccentric region 28. A first or second planet wheel 32 or 33, which planet wheels differ in their diameter, is mounted on each partial eccentric region 27 or 28. A first and second set of planet wheels may also be provided.

In an advantageous variant in FIG. 7, a single eccentric 26, on which a single planet wheel 34 is mounted, which is simultaneously in engagement with both driven internal gear wheels 15, 16, is provided at an adjustment input 18. For the description of further elements, reference is made to the preceding descriptions of the figures.

A third refinement of the invention is shown in FIGS. 8 to 11 with an adjusting gear 17 designed as a tandem planet gear. For the description of elements and functionalities (not explained further), reference is made in general to the above descriptions of the figures. In this preferred refinement, a drive 11 is not located on a driving internal gearwheel but rather on a planet carrier 35. A phase position between in each case two camshafts 21' and 22' and a crankshaft can be changed by rotation of a sun wheel 23.

Figure 8:
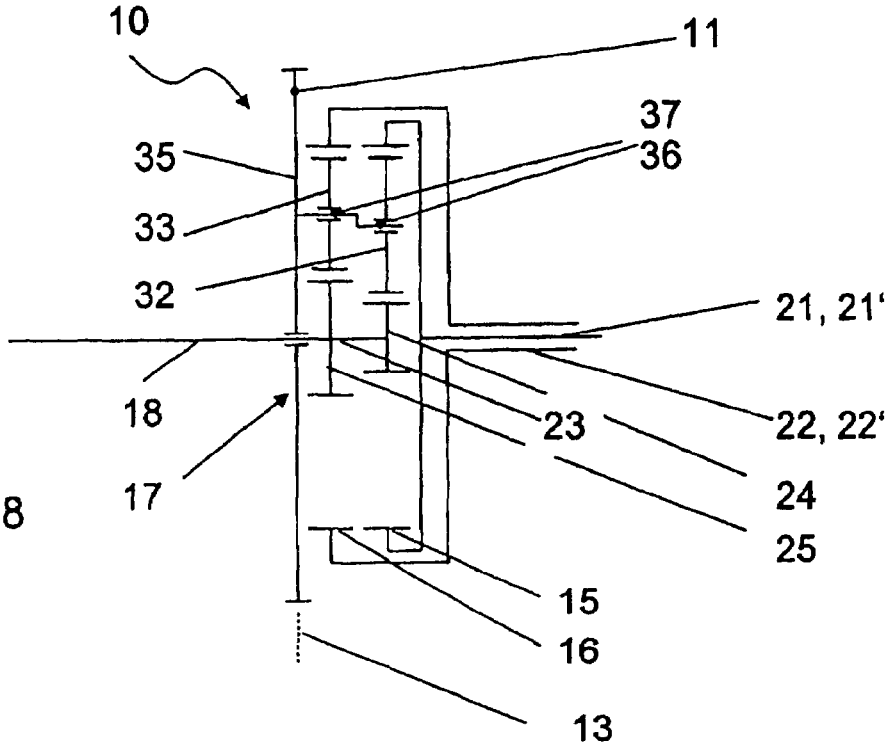
FIG. 8 shows a first arrangement of a tandem planet gear with a sun wheel with two toothings and two planet wheels with differing diameter on a double eccentric.

According to the first variant in FIG. 8, the sun wheel 23 has two gear structures 24, 25 with which two first and second planet wheels 32 and 33, or sets of planet wheels, mounted with partial regions 36, 37 on planet bearing bolts, correspond. The planet wheels 32, 33 have different diameters. The first planet wheel 32 is in engagement with the sun gear 23 and a first driven internal gearwheel 15, and the second planet wheel 33 is in engagement with the sun gear 23 and a second driven internal gearwheel 16.

Figure 9:
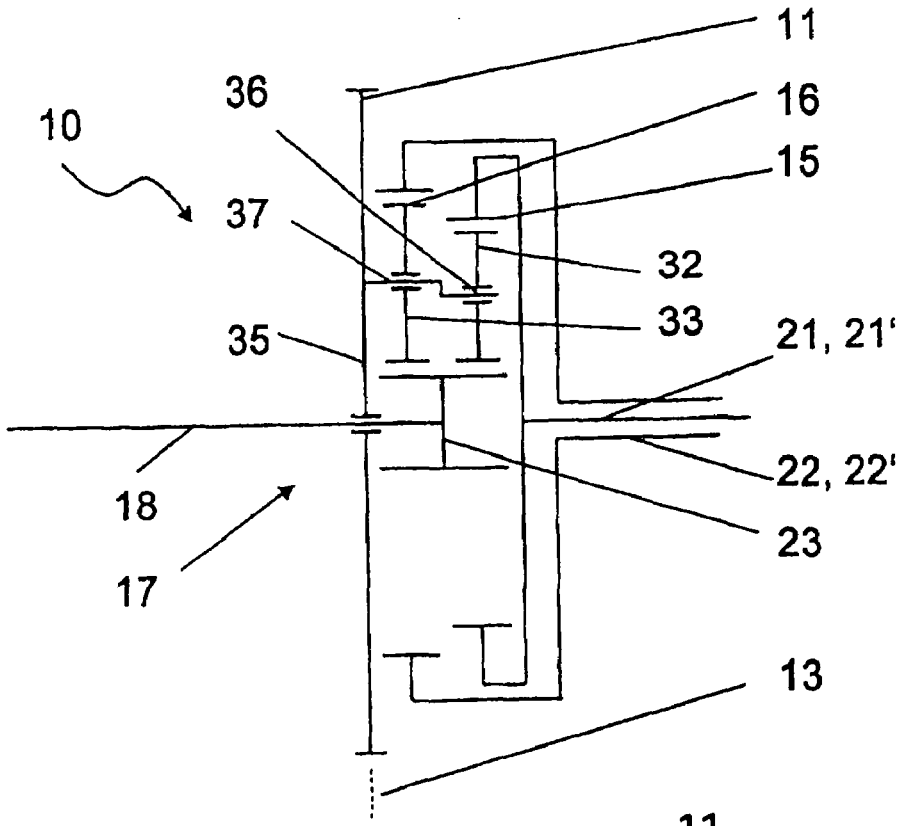
FIG. 9 shows a second arrangement of a preferred tandem planet gear with a sun wheel with a single toothing and two planet wheels with different diameters supported by a double eccentric.

FIG. 9 shows a variant with a sun gear 23 with a single toothing, with which both first and second planet wheels 32 and 33, which are mounted on planet bearing bolts, or first and second sets of planet wheels, are in engagement. The planet wheels 32, 33 have different diameters.

Figure 10:
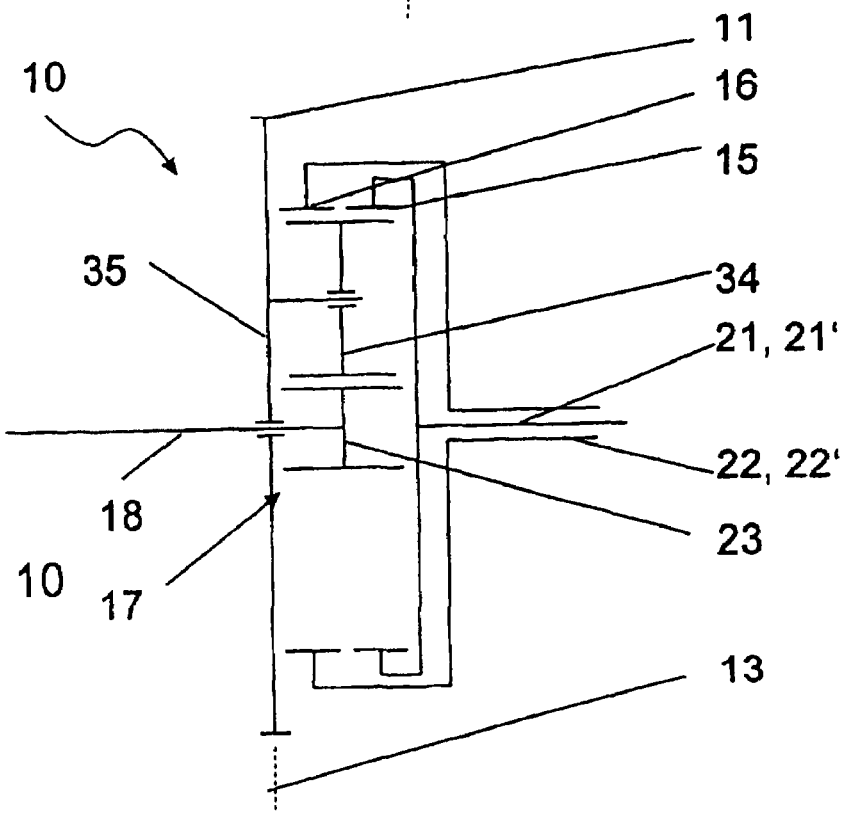
FIG. 10 shows a third arrangement of a preferred tandem planet gear with a sun wheel with a single toothing and a planet wheel.

FIG. 10 shows a variant with a sun gear 23 with a single toothing and a planet wheel 34 which meshes therewith and is simultaneously in engagement with two axially spaced-apart driven internal gearwheels 15 and 16.

A different transmission ratio between adjustment input 18 and a first output 21 and between adjustment input 18 and a second output 22 comes about by means of different numbers of teeth of the driven internal gearwheels 15, 16 of the same diameter by means of profile correction.

Figure 11:
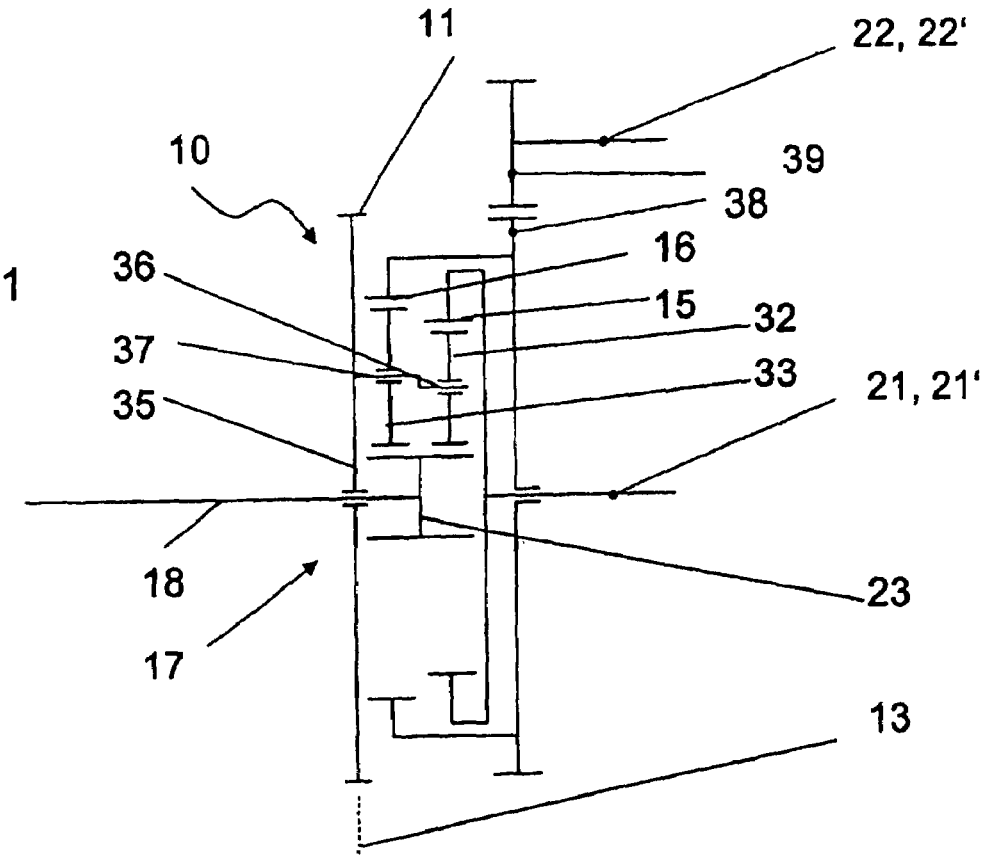
FIG. 11 shows a fourth arrangement of a preferred tandem planet gear with a sun wheel with a single toothing and two planet wheels with a differing diameter on a double eccentric with two camshafts arranged next to each other.

The arrangement in FIG. 11 corresponds to the arrangement in FIG. 9 with the difference that two camshafts 21', 22' are not arranged coaxially at a first and second output 21, 22 but rather that the two camshafts 21', 22' are arranged spaced-apart axially next to each other. For the description of the individual elements and functionalities, reference is again made to FIG. 9 and the further figures.

An output shaft to the first camshaft 21' of a first driven internal gearwheel 15 is guided at its output 21 by means of a carrier of a second driven internal gear wheel 16. On its outer circumference, the second driven internal gear wheel 16 has an external toothing 38 which meshes with an external toothing of a spur gear 39 of the second camshaft 22' and forms a wheel drive for driving the second camshaft 22'.

This arrangement of camshafts 21' and 22' which are located next to each other, in which the second camshaft 22' is driven by a wheel drive of the second driven internal gearwheel 16, is also possible with the above-described refinements with a tandem planet coupling gear and tandem eccentric gear.

What is claimed is:

1. A camshaft adjusting device comprising an adjusting mechanism (17) for adjusting phase positions of first and second camshafts (21', 22') with respect to a crankshaft driving the camshaft adjusting device, said adjusting mechanism (17) having a first output (21) connected to the first camshaft (21') and a second output (22) connected to the second camshaft (22') and also an adjustment input (18) connected to the adjusting mechanism (17) and a drive input (11) for connection to the crankshaft so as to be driven by the crankshaft, said adjusting mechanism having a first transmission ratio for changing the phase angle between the drive input (11) and the first output (21) and a second transmission ratio for changing the phase angle between the drive input (11) and the second output (22) for changing the phase angles between the drive input (11) and the first and second camshafts (21', 22') at different rates when the adjustment input (28) is actuated, the adjustment mechanism (17) further including a first driven internal gearwheel (15) with an internal toothing for driving the first camshaft (21), and a second driven internal gearwheel (16), which is spaced apart axially from the first driven internal gear wheel (15) and has an internal toothing for driving the second camshaft (22), and a driving internal gearwheel (12) connected to the drive input (11) and having an internal toothing in driving connection with the first and second driven internal gearwheels (15, 16).

2. The camshaft adjusting device as claimed in claim 1, wherein the adjusting mechanism includes a sun gear (23) arranged centrally in the adjusting mechanism (17) with a first set of planet wheels (29, 32) being arranged between, and in engagement with, the sun gear (23) and the first driven internal gear wheel (15).

3. The camshaft-adjusting device as claimed in claim 2, wherein a second set of planet wheels (30, 33) is arranged between the sun wheel (23) and the second driven internal gear wheel (16), which planet wheels are in engagement with the sun wheel (23) and the second driven internal gearwheel (16).

4. The camshaft-adjusting device as claimed in claim 3, wherein the first set of planet wheels (29, 32) and the second set of planet wheels (30, 33) have different numbers of teeth.

5. The camshaft-adjusting device as claimed in claim 2, wherein a set of planet wheels (31, 34) is arranged between the sun wheel (23) and the first and second driven internal gearwheels (15, 16) and is in engagement with both the first and the second driven internal gearwheels (15, 16).

6. The camshaft-adjusting device as claimed in claim 2, wherein the sun wheel (23) has two toothings (24, 25).

7. The camshaft-adjusting device as claimed in claim 2, wherein the planet wheels (29, 30, 31) are arranged loosely between the sun wheel (23) and the driven internal gearwheel or wheels (15, 16).

8. The camshaft-adjusting device as claimed in claim 2, wherein the planet wheels (32, 33, 34) are arranged on a planet carrier (35) between the sun wheel (23) and the driven internal gearwheel or wheels (15, 16).

9. The camshaft-adjusting device as claimed in claim 1, wherein the adjustment input comprises an eccentric shaft (26) centrally supported in the adjusting mechanism (17) so as to be rotatable therein for the adjustment of the phase angles between the drive input and the outputs.

10. The camshaft-adjusting device as claimed in claim 9, wherein a set of planet wheels (34) is arranged on the eccentric shaft (26) and is in engagement with both driven internal gearwheels (15, 16).

11. The camshaft-adjusting device as claimed in claim 9, wherein two axially spaced-apart planet wheels (32, 33) or sets of planet wheels are arranged on the eccentric shaft (26), with each of the sets of planet wheels (32, 33) being respectively in engagement with one of the driven internal gearwheels (15, 16).

12. The camshaft-adjusting device as claimed in claim 11, wherein the eccentric shaft (26) is a double eccentric with two partial differently eccentric regions (27, 28).

13. The camshaft-adjusting device as claimed in claim 1, wherein the drive (11) is arranged on a planet carrier (35).

14. The camshaft-adjusting device as claimed in claim 13, wherein a set of a planet wheels (32, 33) is arranged eccentrically on the planet carrier (35).

15. The camshaft-adjusting device as claimed in claim 13, wherein a set of a planet wheel (34) is in engagement with both driven internal gearwheels (15, 16).

16. The camshaft-adjusting device as claimed in claim 15, wherein the driven internal gearwheels (15, 16) have a different number of teeth.

17. The camshaft-adjusting device as claimed in claim 1, wherein the two camshafts (21', 22') are arranged coaxially.

18. The camshaft-adjusting device as claimed in claim 1, wherein the two camshafts (21', 22') are arranged spaced apart next to each other.

19. The camshaft-adjusting device as claimed in claim 1, wherein the second driven internal gearwheel (16) has a wheel drive with external toothings (38, 39) for driving the second camshaft (22').

* * * * *